US010295128B2

(12) United States Patent
Sharrah et al.

(10) Patent No.: US 10,295,128 B2
(45) Date of Patent: May 21, 2019

(54) LIGHTING DEVICE INCLUDING AN LED CHIP-ON-BOARD LIGHT SOURCE AND CONFORMAL LENS

(71) Applicant: STREAMLIGHT, INC., Eagleville, PA (US)

(72) Inventors: Raymond L. Sharrah, Collegeville, PA (US); Cleatis A. Eichelberger, East Norriton, PA (US)

(73) Assignee: Streamlight, Inc., Eagleville, PA (US)

( * ) Notice: Subject to any disclaimer, the term of this patent is extended or adjusted under 35 U.S.C. 154(b) by 232 days.

(21) Appl. No.: 15/256,061

(22) Filed: Sep. 2, 2016

(65) Prior Publication Data

US 2018/0031188 A1 Feb. 1, 2018

Related U.S. Application Data

(63) Continuation-in-part of application No. 29/572,921, filed on Aug. 1, 2016, now Pat. No. Des. 814,675.

(51) Int. Cl.

| | |
|---|---|
| ***F21L 4/02*** | (2006.01) |
| ***F21K 9/90*** | (2016.01) |
| ***F21V 23/06*** | (2006.01) |
| ***F21V 5/04*** | (2006.01) |
| ***F21V 23/04*** | (2006.01) |
| *F21Y 115/10* | (2016.01) |

(52) U.S. Cl.

CPC ..... *F21L 4/02* (2013.01); *F21K 9/90* (2013.01); *F21V 5/04* (2013.01); *F21V 23/0414* (2013.01); *F21V 23/06* (2013.01); *F21Y 2115/10* (2016.08)

(58) Field of Classification Search

CPC ..... F21L 4/02; F21V 5/04; F21V 23/0414; F21V 23/06; F21K 9/90

See application file for complete search history.

(56) References Cited

U.S. PATENT DOCUMENTS

| | | | |
|---|---|---|---|
| 3,310,668 | A | 3/1967 | Schwartz |
| 5,515,248 | A | 5/1996 | Canfield |
| 6,609,811 | B1 | 8/2003 | Sharrah |
| D492,050 | S | 6/2004 | Chung |

(Continued)

OTHER PUBLICATIONS

Streamlight, Inc., "KEYMATE USB Ultra-Compact Hands-Free Area Light", © 2016, http://www.streamlight.com/docs/default-source/data-sheet/keymateusb_datasheet.pdf?sfvrsn=4.

(Continued)

*Primary Examiner* — Joseph L Williams

(74) *Attorney, Agent, or Firm* — Clement A. Berard, Esq.; Dann, Dorfman, Herrell & Skillman, PC

(57) ABSTRACT

A lighting device includes: a housing configured to receive a light emitting circuit and a battery; a light emitting circuit including one or more light emitting diodes mounted to a circuit board; a translucent or transparent conformal lens formed to cover the one or more light emitting diodes; and an electrical switch for selectively energizing the light emitting diodes to produce light. The housing may be in a shape resembling a key. A method for making a lighting device includes: obtaining a circuit board having one or more light emitting devices; obtaining a housing configured to receive the circuit board; placing the circuit board in the housing; then dispensing a conformal coating material onto the circuit board; allowing the dispensed conformal coating material to spread and level; and curing the conformal coating material to form a cover on the circuit board.

45 Claims, 6 Drawing Sheets

(56) References Cited

U.S. PATENT DOCUMENTS

| | | | |
|---|---|---|---|
| RE38,549 | E | 7/2004 | Seebock |
| D495,073 | S | 8/2004 | Kumthampinij |
| D496,848 | S | 10/2004 | Freeman |
| D507,369 | S | 7/2005 | Waters |
| 7,036,950 | B1 | 5/2006 | Freeman |
| D530,186 | S | 10/2006 | Johansson |
| D538,192 | S | 3/2007 | Martin |
| D656,651 | S | 3/2012 | Gorman |
| D661,479 | S | 6/2012 | Wu |
| D669,619 | S | 10/2012 | Ormsbee |
| 8,297,800 | B1 | 10/2012 | Little |
| D676,650 | S | 2/2013 | Farris |
| 8,628,210 | B2 | 1/2014 | Tucker et al. |
| D732,215 | S | 6/2015 | Su |
| 9,061,427 | B2 | 6/2015 | Rubin |
| D738,554 | S | 9/2015 | Dalton et al. |
| 2010/0277914 | A1 | 11/2010 | Bachl et al. |
| 2012/0182727 | A1 | 7/2012 | Sharrah et al. |
| 2012/0248477 | A1 | 10/2012 | Tischler et al. |
| 2014/0240967 | A1 | 8/2014 | Sharrah et al. |
| 2015/0155453 | A1 | 6/2015 | Peil et al. |
| 2016/0091153 | A1 | 3/2016 | McLennan et al. |

OTHER PUBLICATIONS

International Searching Authority, "PCT—International Search Report & Written Opinion", PCT/US2017/042380, dated Oct. 10, 2017, 15 pages.

Streamlight, Inc., "KEYMATE USB Ultra-Compact Hands-Free Area Light", © 2016, http://www.streamlight.com/docs/default-source/data-sheet/keymateusb_datasheet.pdf?sfvrsn=4, Published Nov. 2016.

Streamlight, Inc., "CuffMate, Handcuff Key", printed Oct. 31, 2016, 2 pages, http://www.streamlight.com/products/detail/index/cuffmate.

Streamlight, Inc., "The LOGO, Keychain Flashlight", printed Oct. 31, 2016, 2 pages, http://www.streamlight.com/products/detail/index/the-logo.

LEDNews, "What's COB LED?", © 2013, 7 pages, http://www.lednews.org/what-cob-led-chip-on-board-definition/.

Lightspot, "What is COB?", printed Oct. 24, 2016, 1 page, http://www.cob-led.com/what-is-cob-led-chips-on-board.html.

Lightspot, "Patent introduction", printed Oct. 24, 2016, 1 page, http://www.cob-led.com/cob-led-module-chips-on-board-patent.html.

Lightspot, "COB Advantage", printed Oct. 24, 2016, 3 pages, http://www.cob-led.com/cob-led-advantage-chip-on-board.html.

Masterbond, "Protecting Chip on Board (COB) Devices with Glob Top Encapsulants", printed Oct. 24, 2016, 6 pages, http://www.masterbond.com/whitepaper/protecting-chip-board-cob-devices-glob-top-encapsulants.

Nebo, "SLYDE King Rechargeable Work Light & Flashlight Manual", © 2016, 1 page.

Nebo, "#6434 SLYDE King", printed Aug. 1, 2016, 2 pages, https://www.nebotools.com/prod_details.php?id=407&cid=&subsid&subsubcid=.

Nebo, "#6436 TWYST Z Work Light, Lantern & Flashlight", printed Aug. 1, 2016, 2 pages, https://www.nebotools.com/prod_details.php?id=406.

Nebo, "#6431 Larry Boss", printed Aug. 1, 2016, 2 pages, https://www.nebotools.com/prod_details.php?id=408.

Nebo, "#6492 Lil Larry—The Power Pocket Light", printed Aug. 1, 2016, 2 pages, https://www.nebotools.com/prod_details.php?id=414&cid=&subsid&subsubcid=.

Plasma Rugged Solutions, "LED & Electronic Conformal Coating Services", printedJul. 18, 2016, 3 pages, https://www.plasmarugged.com/led-coating-encapsulation.

Epoxies, "Water Clear Optically Transparent Epoxy Potting Compound & Adhesive", Technical Bulletin, Jul. 2012, 2 pages.

Epoxies, "Potting and Encapsulating Silicone Gels", Technical Bulletin, Mar. 2013, 2 pages.

Dymax, "Light CAP High-Performance LED Protection", Application Bulletin, Jun. 12, 2012, 2 pages.

Dymax, "Light CAP LED Casting Resin", printed Jul. 18, 2016, 2 pages, https://www.dymax.com/index.php/adhesives/products/9622.

Dymax, "Light CAP 9622 LED Casting Resin Product Data Sheet", Rev. Apr. 30, 2013, 3 pages.

Dow Corning, "LED Lighting Product Selection Guide", © 2016, 16 pages.

LIGHTING DEVICE INCLUDING AN LED CHIP-ON-BOARD LIGHT SOURCE AND CONFORMAL LENS

This application is a continuation-in-part of U.S. patent application Ser. No. 29/572,921 filed Aug. 1, 2016, and entitled "LIGHT RESEMBLING A KEY OR SIMILAR ARTICLE," which is hereby incorporated herein by reference in its entirety.

The present invention relates to a lighting device and, in particular, to a lighting device employing a chip-on-board arrangement and to a method for making same.

There is a need for a lighting device that is both small and provides a usable level of light, that is suitable to be carried on a key ring or in a pocket or purse, while being relatively economical. Examples of such lighting devices include, e.g., the NANOLIGHT® lights, the Key-Mate® lights, the LOGO™ fob light and the CuffMate® light, all available from Streamlight, Inc. of Eagleville, Pa.

The foregoing derive operating power from one or more small button-cell batteries that are single use batteries that cannot be recharged. While that arrangement is highly satisfactory in many, if not most, situations, it would further be desirable to provide such small lighting device that is also rechargeable.

The foregoing also employ one or more separately packaged light emitting diodes that are soldered or otherwise mounted therein to provide light when energized. Such separate light emitting diodes tend to be in a package that is substantially larger than the semiconductor chip that is the light emitting diode itself, tend to have relatively low light output, and also tend to be more costly to purchase and assemble. In addition, using plural light emitting diodes so packaged can be awkward to arrange and to package, especially in a small light, and can be costly to purchase and assemble.

Applicant believes there may be a need for a lighting device that is economical and is rechargeable, and that employs a structure and construction that simplifies assembly, thereby to possibly reduce assembly cost. It would also be desirable if more light intensity could be obtained, e.g., in a smaller light without having to employ a larger, e.g., flashlight sized, package.

Accordingly, a lighting device may comprise: a housing configured to receive a light emitting circuit and a battery; a light emitting circuit including one or more light emitting diodes mounted to a circuit board; a translucent or transparent conformal lens formed to cover the one or more light emitting diodes; and an electrical switch for selectively energizing the one or more light emitting diodes to produce light. The housing may be in a shape resembling a key.

A method for making a lighting device may comprise: obtaining a circuit board having one or more light emitting devices; obtaining a housing configured to receive the circuit board; placing the circuit board in the housing; then dispensing a conformal coating material onto the circuit board; allowing the dispensed conformal coating material to spread and level; and curing the conformal coating material to form a cover on the circuit board.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1A:
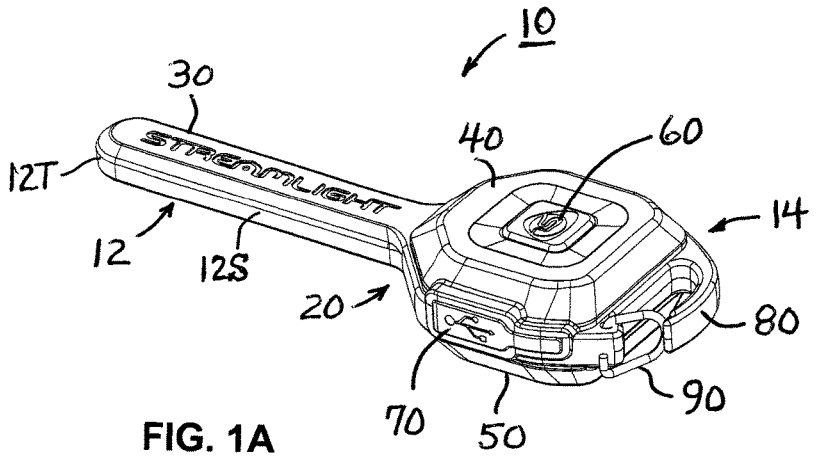
FIGS. 1A and 1B are perspective views of an example embodiment of a lighting device according to the present arrangement viewed from different directions.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 1B:
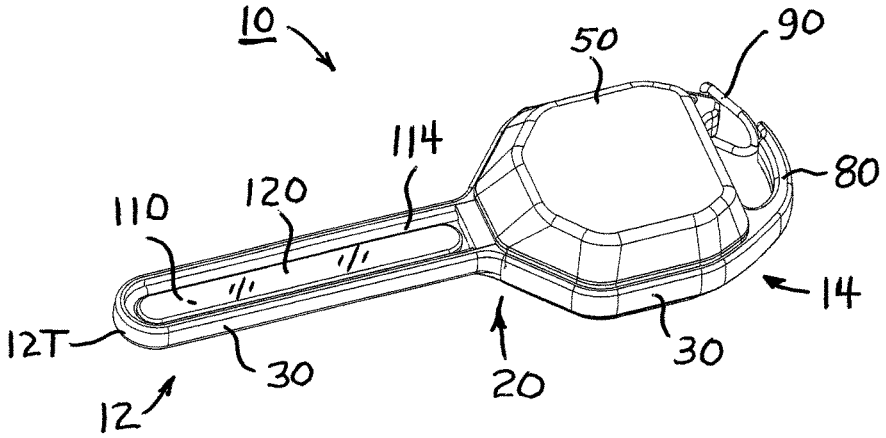
Figure 2:
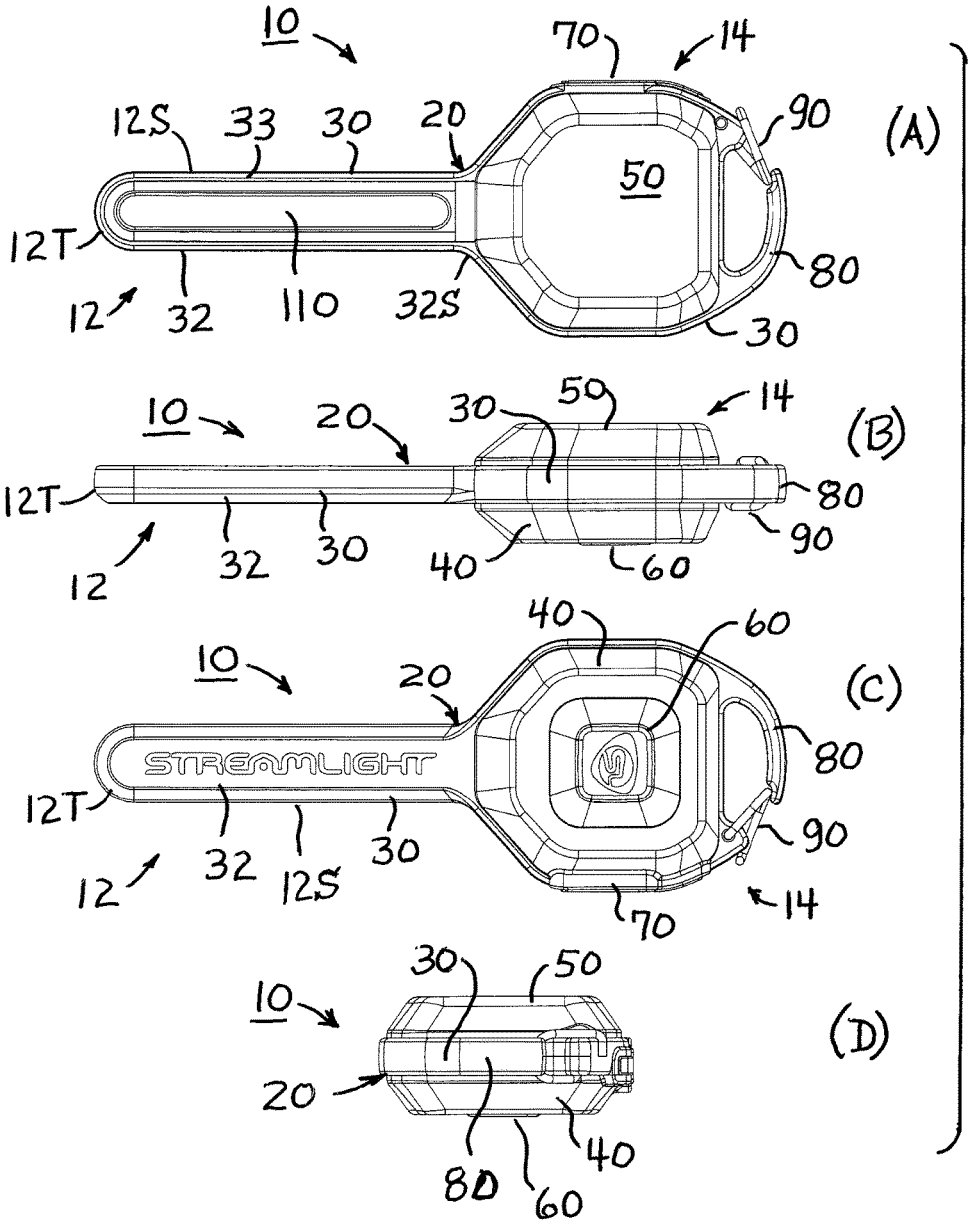
FIG. 2 is a set of orthogonal views (A) through (D) of the example lighting device of FIGS. 1A and 1B.

FIGS. 1A and 1B are perspective views of an example embodiment of a lighting device 10 according to the present arrangement viewed from different directions and FIG. 2 is a set of orthogonal views (A) through (D) of the example lighting device 10 of FIGS. 1A and 1B. Lighting device 10 in the example embodiment illustrated is substantially in the shape of a key having a blade end 12 and a bow end 14. Light 10 has a housing 20 substantially in the shape of a key as used for unlocking a lock, e.g., being evocative of that shape, however, light 10 and housing 20 may be made in different shapes. Housing 20 comprises a substantially key shaped main housing part 30 having a blade end 12 defining a recess or channel 33 and a bow end 14, wherein the bow end 14 of main housing 30 supports a top cover 40 having a switch actuator 60 therein and a bottom cover 50.

Optionally, and for convenience, hook or hanger or loop 80 may be provided on the bow end of housing 20, e.g., preferably of main housing part 30, for enabling light 10 to be attached to a key ring (not shown) or hung on a pin or post or hook, e.g., of a key rack, (not shown), as would a key for a lock. Loop or hanger 80 may be a closed loop as in a usual key or may have an opening or gap such as may be closed by a spring gate 90 or other openable closure structure. While light 10 and its housing 20 are described as being key-shaped and are not illustrated as having operative keying features, e.g., cuts for pin tumbler locks or wards for a lever tumbler lock, as in the presently preferred and illustrated embodiment, such features may be provides so that light 10 may also serve as an operative key.

Preferably, light 10 is powered by a rechargeable battery (not visible in FIGS. 1A-2), which may be recharged while inside housing 20 thereof, e.g., in a cavity defined between top and bottom covers 40, 50. Current for recharging the internal battery is preferably received via a small connector, e.g., a USB connector, a mini-USB connector, a micro-USB connector or a lightning connector, which is enclosed under a connector cover 70 to reduce the likelihood of dirt, debris and/or moisture from entering such connector. Preferably, connector cover 70 is tethered to housing 20 so as to not be easily misplaced or lost.

Blade 33 of main housing part 30 preferably has a channel or recess 33 therein, preferably an elongated channel or recess 33 in one broad surface thereof, in which is mounted an electronic circuit board 110 upon which are mounted one or more light emitting diodes (LEDs) for emitting light. The LEDs of circuit board 110 preferably provide sufficient light so as to be useful for illuminating a desired object, and so will provide a relatively higher brightness, consistent with an intended use.

In one embodiment, the opposing broad surface may be utilized for labeling or one sort or another, e.g., a manufacturer name such as STREAMLIGHT® or a warning or other information label, or may be provided with a pattern, e.g., a cut pattern as in a wavy groove or internal-cut key or a pattern of raised bumps and/or recesses that define a keying pattern, operative to lock and/or unlock a lock. Main housing part 30 may also define a shoulder 12S where it is to be used as an operative key.

In a preferred embodiment, e.g., as illustrated, LED circuit board 110 and switch actuator 60 are positioned on opposing surfaces of housing 20 of light 10. Thus, the relatively bright illuminating light produced by the LEDs of LED circuit board 110 will be directed, e.g., in a generally downward direction when a user holds light 10 in his hand with the button on top so as to be conveniently actuatable by his thumb, or forward or to the side with rotation of his wrist.

Figure 3:
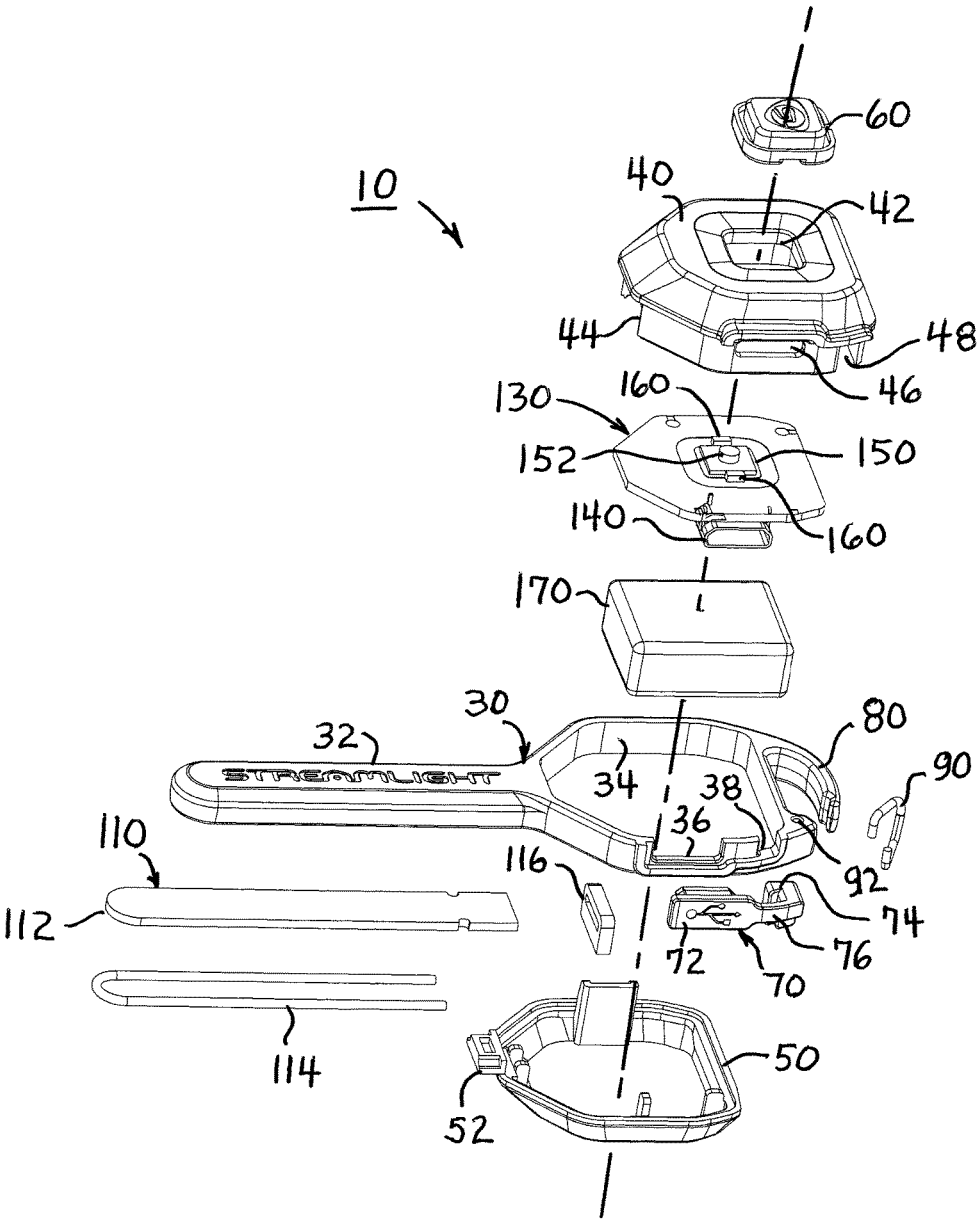
FIG. 3 is an exploded view of the example lighting device of FIGS. 1A, 1B and 2.

FIG. 3 is an exploded view of the example lighting device 10 of FIGS. 1A, 1B and 2, illustrating various elements thereof. Therein housing 20 comprises main housing part 30, top cover 40 and bottom cover 50 which when assembled together substantially define the exterior of light 10 and of housing 20 thereof. For an example light 10 that is substantially key shaped, e.g., as illustrated, main housing 30 comprises a blade end 32 having a channel or recess 33 and that is integral with and extending from a bow end 34 that has a peripheral wall, e.g., the combination being in a shape evocative of or resembling a key for a lock.

The peripheral wall of bow end 34 defines a cavity interior thereto into which a control electronic circuit board 130 and a rechargeable generally rectangular battery 170 are disposed between top cover 40 and bottom cover 50. In the wall of bow end 34 are one or more gaps or openings 36, and optionally, 38. Opening or recess 36 is of a size and shape to receive and hold connector cover 70 which is intended to reduce the ability of dirt and debris to enter into connector 140, and to provide access to connector 140, e.g., a micro-USB connector or other small connector, internal to light 10 to which an external source of charging power may be connected via a compatible USB connector and/or USB cable and/or USB charging cube.

In a preferred arrangement, optional opening or recess 38 is of a size and shape to receive an end 74 of connector cover 70 that is retained in housing 20, 30 so as to attach USB cover 70 thereto. The cover part 72 of connector cover 70 that covers/closes the access opening 36, 46 to connector 140 is preferably tethered, e.g., by a flexible tether 76 that extends between connector cover 72 and captive end 74 or base part 74 which is retained in an opening or receptacle defined by housing 30 and/or top cover 40.

Extending from an end of bow 34 is an optional loop or hanger 80 that is integral to main housing 30. Where hanger or loop 80 is not closed in shape, but has an opening or gap therein, a spring gate 90 or other suitable closure is preferably provided and is biased to close the gap in hanger or loop 80.

Bottom cover 50 when assembled to main housing 30 has a broad surface that is adjacent to battery 170 and has a peripheral wall that corresponds in shape and size with the bow end 34 of main housing part 30 and resides therein. Cover 50 has an extension 52 at the end thereof proximate to blade end 32 of housing 30 that, with rubber support 116, helps to position and/or support the end of LED electronic circuit board 110 distal from the tip end 112 thereof.

Control electronic circuit board 130 is disposed on top of battery 170 and makes electrical connection thereto either via electrical contacts on the bottom or underside thereof that are adjacent to and press against corresponding contacts of battery 170 or by electrical conductors, e.g., wires, that are soldered or other wise attached to the respective parts 130, 170. Mounted to and connected at the underside of circuit board 130 is an electrical connector 140 that is positioned so as to be accessible via the opening 36 of main housing 30 to receive a compatible mating connector via which electrical charging voltage and current may be provided to recharge battery 170. Where light 10 is relatively small and is e.g., evocative of a key, connector 140 is preferably a USB connector 140, more preferably a mini-USB connector 140, and even more preferably a micro-USB connector 140, or a lightning connector 140.

Mounted to, e.g., the upper side of control circuit board 130 is, among other components, an electrical switch 150 that is actuated in various sequences and/or timings to selectively control light 10 to produce light, e.g., via LEDs mounted on LED circuit board 110. The LEDs on circuit board 110 may be operated in states of, e.g., on, off, momentarily on, blinking, flashing, strobing, dimming, undimming, and the like, as may be desired and as may be programmed into the control circuit of circuit board 130. Switch 150 is positioned on circuit board 130 so as to be substantially adjacent to actuator cover 60 when top cover 40 is assembled to main housing 30, in a preferred arrangement, both actuator cover 60 and switch 150 are substantially centered with respect to top cover 40 and bow end 34. Thus, actuator cover 60, also referred to as a boot 60, which is resilient and/or flexible, is adjacent to switch 150, and so applying pressure to actuator cover 60 causes it to move inwardly toward and actuate switch button 152 thereby to actuate electrical switch 150 for controlling light 10.

Boot or cover 60 resides in opening 42 of top cover 40 and preferably provides a seal around its periphery, either due to pressure or to being positively attached to the interior of top cover 40, e.g., by adhesive, ultrasonic weld, over-molding, or any other suitable fastener. Top cover 40 has a somewhat dome shape and has a downward extending wall that extends into main housing 30 where is attached to bottom cover 50, e.g., by adhesive, ultrasonic weld or any other suitable fastener. Openings in the wall of top cover 40 may be provided for various functions, e.g., an opening 42 for receiving actuator cover 60, a recess or gap 44 through which circuit board 110 may be disposed, an opening or gap 46 through which connector 140 may be accessed, and an opening 48 for retaining (with opening 38 of main housing 30) the anchor or captive end 74 of tethered connector cover 70.

Also located on control circuit board 130 are one or more LEDs 160 that are arranged to provide an indication of the charging and/or charging status of battery 170. To that end, one LED 160 may be a green LED, e.g., to indicate that charging current is being received or that charging is complete, or may be a red LED, e.g., to indicate that battery 170 is relatively depleted and is in need of being charged or that it is charging. The different colors and modes of operation (e.g., either or both being on continuously, flashing, and the like) of LEDs 160 may be utilized to indicate various conditions of light 10 and/or of battery 170, as may be desired.

Preferably, actuator cover or boot 60 is partly or completely of a transparent or translucent material so that the light produced by LEDs 160 is visible from external to light 10, e.g., by a user thereof. Actuator cover or boot 60 is also preferably of a relatively flexible and/or resilient material so that it will easily deform when pressed thereby to actuate electrical switch 150 and preferably will return substantially to its un-deformed shape, either due to its own resiliency or due to the action of switch 150 to return its actuator button 152 to the un-actuated position when pressure is released.

Main housing 30 preferably provides a channel or recess 33, e.g., in blade part 32, having a size and shape for receiving LED circuit board 110 therein. LED circuit board 110 preferably has one or more LEDs thereon, and preferably having one or more LEDs in chip form directly mounted, e.g., by surface mounting with wire bonds, to the electrical circuit board 110. In that form, sometimes referred to as "chip-on-board" or "COB" construction, circuit board 110 can be relatively thin whereby the recess 33 or channel 33 can be correspondingly shallow, and blade 32 can also be relatively thin, whereby light 10 may be relatively thin.

In a preferred arrangement, LED COB circuit board 110 is retained in the channel or recess 33 by a U-shaped spring holder 114 that has a shape and size substantially corresponding to the shape and size of recess 33 and COB 110. Preferably the closed end of U-shaped holder 114 is near the tip 112 of blade end 32 of main housing 30 and the parallel legs thereof extend along the edges of COB 110. Also preferably, the sides of recess 33 may have a small lip or groove that helps to retain spring holder 114 therein.

While a transparent or translucent lens may be placed in recess 33 over COB circuit board 110, another lens covering is preferred. In one preferred arrangement, a conformal coating of a clear (optically transparent or translucent) material is applied over COB circuit board 110 and spring holder 114 thereby to in a single operation provide retention of circuit board 110 and spring holder 114 in the channel recess 33 of main housing 30 as well as to provide a seal therefor and a lens therefor.

Actuator cover or boot 60 and/or conformal coating material 120 may be transparent or translucent, or may have a transparent or translucent portion thereof, and may be clear (colorless) or may be its natural color or may be tinted to any desired color.

Figure 4C:
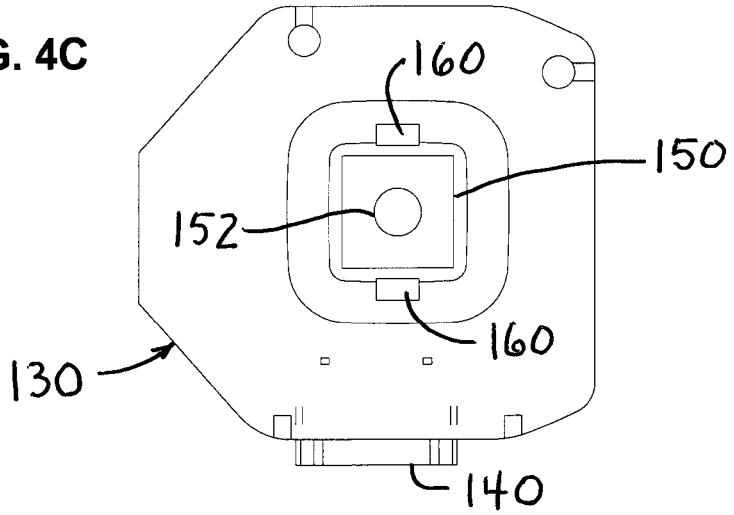
FIG. 4C is an enlarged plan view of a portion thereof.
Figure 4A:
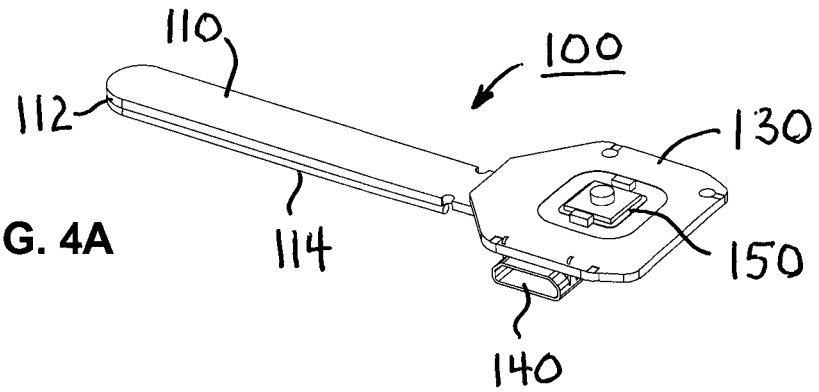
FIGS. 4A and 4B are perspective views of an example embodiment of a circuit board structure internal to the example lighting device of FIGS. 1A, 1B, 2 and 3 viewed from different directions.
Figure 4B:
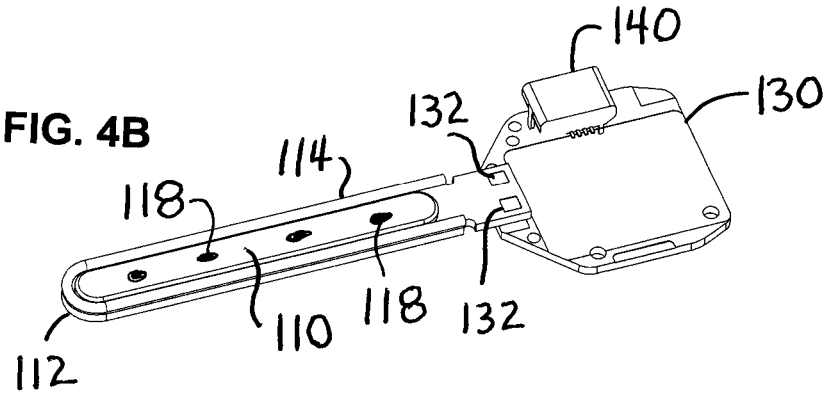

FIGS. 4A and 4B are perspective views of an example embodiment of a circuit board structure 100 internal to the example lighting device 10 of FIGS. 1A, 1B, 2 and 3 viewed from different directions, and FIG. 4C is an enlarged plan view of a portion 130 thereof. Circuit board assembly 100 includes a LED circuit board 110 and a control circuit board 130 that are joined together. Specifically, LED circuit board 110 has a shape and size compatible with the channel or recess 33 in blade part 32 of main housing part 30; control circuit board 130 that has a shape and size compatible with the enclosed volume defined between top cover 40 and bottom cover 50 when covers 40, 50 are disposed in the bow end 34 of main housing part 30 with battery 70.

Example control circuit board 130 has an electrical switch 150 on one surface thereof and a USB connector 140 preferably disposed on the opposing surface thereof in an orientation that aligns USB connector 140 with the openings 36, 46 defined by main housing part 30 and by top cover 40. Electrical switch 150 is preferably substantially centered in a position on circuit board 130 so as to be adjacent to actuator cover 60 which is substantially centered in top housing 40, so as to be actuatable by pressing actuator cover 60.

Example LED circuit board 110 is preferably a chip-on-board arrangement that has plural surface mountable LED chips 118, and optionally other electrical or electronic components, mounted to one broad surface of an electrical circuit board, e.g., a printed circuit board. Chip-on-board electronic circuit boards are characterized by, e.g., one or more light-emitting-diode chips mounted on a substrate and wire bonded thereto, however, other configurations and/or arrangements may be employed.

When circuit board 110 is disposed in the channel or recess 33 of blade end 32 of main housing part 30, the surface (side) of circuit board 110 that carries the LED chips is exposed, thereby to direct light produced by the LEDs outwardly from light 10. Spring holder 114 may be provided to hold circuit board 110 in recess 33, e.g., by its elongated spring legs resiliently spreading apart to engage a groove in the interior peripheral walls of blade end 32 that define recess 33.

The substrate of circuit board 110 may include an electrically insulating substrate, e.g., FR-4 material, on which are provided areas of copper or other heat conductive material and/or filled through holes, e.g., solder filled holes, that increase thermal conductivity. Alternately, the substrate of circuit board 110 may be made of a thermally conductive material, e.g., a metal or ceramic or a laminate, having electrical conductors formed thereon, and if not electrically insulating, e.g., a metal, then also including an insulating layer underlying at least the electrical conductors thereon. Optionally, a thermally conductive interface material, e.g., a thermally conductive grease or adhesive, may be provided between circuit board 110 and the bottom of recess 33 of main housing 30.

Example circuit boards 110 and 130 may be joined or attached together 132, e.g., in substantially parallel planes, to form circuit structure 100 or circuit assembly 100 in a manner that provides physical attachment and electrical interconnections 132 therebetween. Such attachment 132 may include solder connections, soldered posts or wires, electrically conductive and/or insulating adhesives, or other suitable fasteners.

Example control circuit board 130 may also include, and preferably does include, one or more light emitting diodes (LEDs) 160 disposed so as to illuminate outwardly through the underside of transparent or translucent actuator cover 60 through which light produced by one or both LEDs 160 may be perceived. In a preferred embodiment, two LEDs 160 are provided, e.g., a red LED 160 and a green LED 160, in positions flanking electrical switch 150, to indicate the status of rechargeable battery 70 and the charging thereof. LEDs 160 may be positioned in any location suitable for being perceived via a transparent or translucent portion of housing 20 and/or any part thereof. Typically, LEDs 160 are to provide indicating light, and so need only provide a relatively low brightness.

In one example light 10, a continuous red indication from LEDs 160 can indicate that the battery is charging and a continuous green indication can indicate that the battery is fully charged. Optionally, a blinking green indication can indicate that the battery is approaching being fully charged. These indications are preferably provided only when light 10 is receiving charging power at USB connector 140. Any other desired indication scheme and coloration may be employed. For example, a blinking red indication could be used to indicate that the battery 170 of light 10 is in need of charging, and could be provided even when light 10 is not connected to a source of charging power.

Example control circuit board 130 may also include, and preferably does include, a microprocessor or other controller that controls the operation of light 10 in response to user inputs made by pressing and releasing actuator 60 to activate and release electrical switch 150. The number, frequency and/or timing of actuations of switch 150 via actuator 60 is employed to program the microprocessor to operate light 10 in an operating state indicated by the particular actuation sequence. Typical operating states for light 10 include, e.g., continuously on at a relatively lower brightness, continuously on at a relatively higher brightness, blinking, and off, although other operating states, e.g., flashing, strobing and other patterns, may be provided. A two second period without any actuation of button 60 puts the microprocessor in a state to turn the light 10 off upon the next actuation.

Light 10 may also include an operating mode which may be referred to as a "Try Me" mode. In the "Try Me" mode, light 10 is maintained in a momentary operating state wherein actuation of electrical switch 150 via actuator button 60 turns the LEDs 118 on for only as long as button 60 is actuated, e.g., a momentary on operating mode. The "Try Me" mode is accessed and established when the control circuit of light 10 is connected to a charged battery 170, e.g., upon assembly thereto. No other operating mode can be accessed unless and until light 10 is connected to a source of external charging power that applies charging current to battery 170, whereupon the "Try Me" operating mode is disabled, e.g., preferably permanently, and light 10 can be operated by actuating electrical switch 150 via actuator 60 to access any of the programmed operating modes (except the "Try Me" mode). Advantageously, the "Try Me" mode offers prospective purchasers the opportunity to try light 10 prior to purchase, e.g., when light 10 is in its package. The package is configured such that actuator 60 may be actuated from outside of the package and an opening or transparent cover of the package permits the light produced by light 10 to exit the package.

Circuit assembly 100 preferably includes all of the electrical elements of light 10 except for the battery, thereby advantageously making possible the testing of the complete electrical circuit of light 10 before it is placed into light 10. This provides an advantage in production, e.g., particularly where the elements 30, 40, 50, 60, 70, 170 of light 10 are assembled together permanently, because it substantially reduces the likelihood that an assembled light 10 will be non-operative, and so production yield is advantageously increased.

Figure 5:
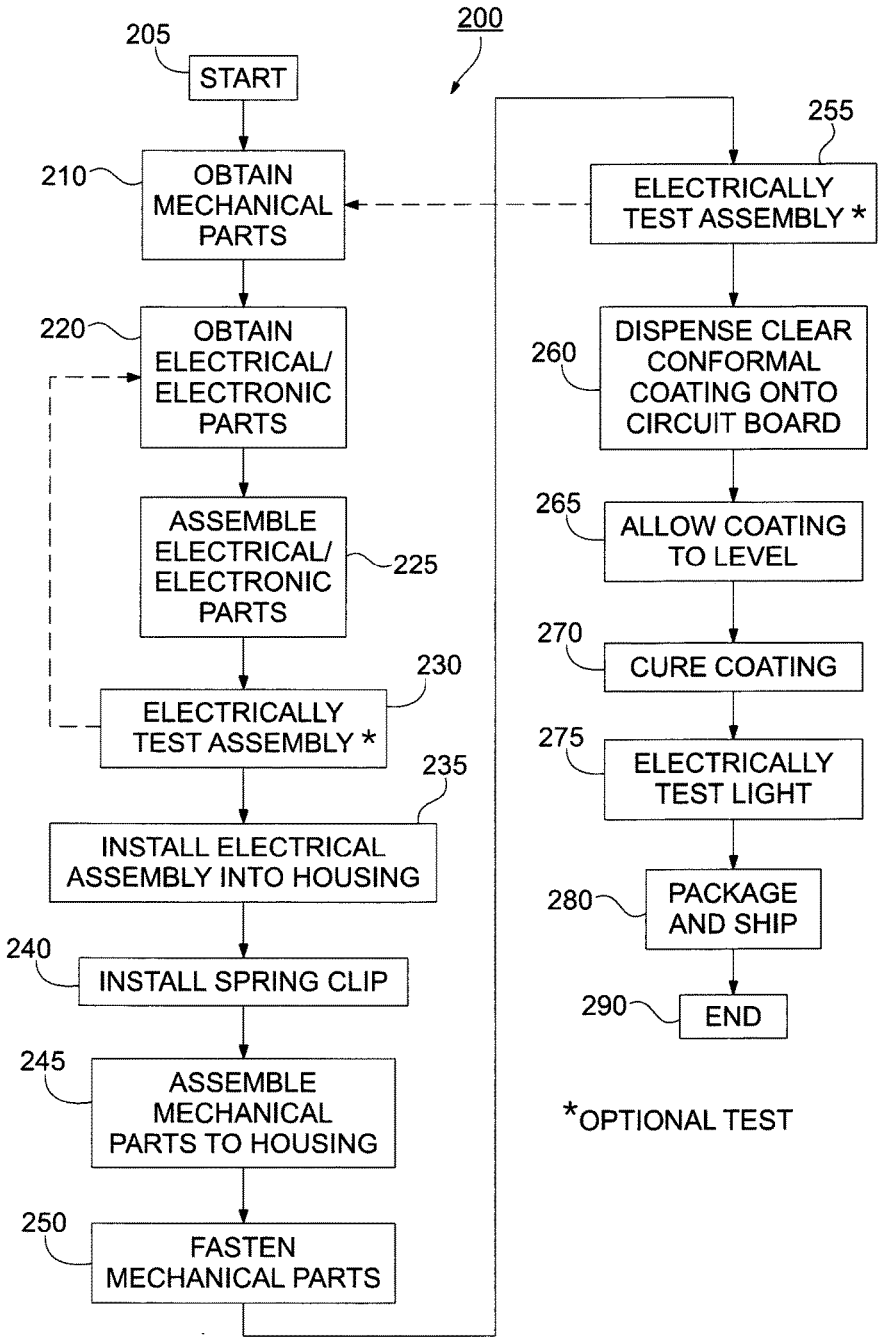
FIG. 5 is a is a schematic diagram flow chart of the method for making the example lighting device of FIGS. 1-4.

FIG. 5 is a is a schematic diagram flow chart of the method 200 for making the example lighting device 10 of FIGS. 1-4. The novel structure of light 10 lends itself to a novel method 200 for making light 10 as follows. It is noted that while the steps are described in an order, that order of steps is generally not required and the steps can be performed in any suitable order. Moreover, some of the steps, e.g., electrical testing steps 230 and 255 are optional, but may be desirable under certain circumstances, e.g., where the parts of light 10 as thus far assembled lend them selves to being tested together and/or where rework to repair or replace a non-operative part would be inconvenient and/or expensive.

Process 200 commences 205 followed by (in any order) obtaining 210 the mechanical parts of light 10, e.g., main housing 30, covers 40 and 50, actuator 60, connector cover 70, spring holder 114 and gate 90, and obtaining 220 the electrical parts of light 10, e.g., circuit boards 110 and 130, and battery 170.

Having obtained 210, 220 each of the parts or elements 20-90 and 110-170 of lighting device 10, assembly of light 10 then proceeds. Variations in the order of the steps to be described are contemplated and so the steps may be performed in any suitable order permitted by any remaining steps. Steps shown as being in series may be performed in a different order or may be performed in parallel, and vice versa. For example, electrical testing 230 of the circuit structure 100 may be performed by interconnecting circuit boards 110, 130 before they are assembled 225, and/or may be performed after circuit structure 100 is placed 235 into housing 20 or 30, and/or after lighting device 10 is fully assembled 275, as may be convenient.

Also by way of example, the assembling of actuator cover 60 into top cover 40 may be performed before the mechanical parts are obtained 210 or as part of mechanical assembly 245 or otherwise; but placing connector cover 70 into main housing 30 is performed before the top and bottom covers 40, 50 are assembled with main housing 30. Actuator boot or cover 60 is preferably assembled into opening 42 of top cover 40 by, e.g., being co-molded with top cover 40 or if a separate part, being inserted into top cover 40. Boot 60 is retained in top cover 40 either by a friction fit, e.g., of complementary features such as a ridge of one and a groove in the other, or by being attached to the interior of top cover 40, e.g., by adhesive, heat welding, ultrasonic welding or any other suitable fastening.

Assembly 225 of electrical parts includes attaching and connecting LED circuit board 110 to control circuit board 130, each of which already has its electronic parts, e.g., LEDs 118, switch 150, LEDs 160 and USB connector 140 thereon, to form electronic circuit board assembly 100. Control circuit board 130 and LED circuit board 110 may be assembled 225 into circuit structure 100, e.g., by soldering, adhesive or other fastening, and may thereafter be electrically tested 230 by being connected to an electrical power source, which may or may not be a battery 170. Preferably battery 170 is attached and connected to circuit board assembly 100, e.g., to control circuit board 130 thereof, to form an assembly that contains all of the electrically operating parts of lighting device 10 and so is electrically operable and may be electrically tested 230 as a complete unit at this stage of assembly.

Electrical circuit board assembly 100 is installed 235 into the housing, specifically into the main housing part 30 which has a channel 33 in blade 32 to receive the elongated LED circuit board 110 thereof. This is accomplished by inserting the circuit board assembly 100 into the bow 34 of main housing part with the elongated LED circuit board 110 thereof being inserted through an opening in the blade end of bow 34 so that elongated circuit board 110 slides into elongated channel 33 in blade 32 until it is fully seated in place therein, and control circuit board 130 is in bow part 34 surrounded by the peripheral wall 34 of main housing part 30. Spring clip 114 is placed 240 into channel 33 preferably to snap into a peripheral recess or groove in channel 33 wherein it retains itself and circuit board 110 in a desired position in channel 33 with support from rubber support 116.

Mechanical assembly step 245 may now be performed. Top cover 40 has a downward extending wall and bottom cover 50 has an upward extending wall that are both placed 245 into the peripheral bow 34 of main housing 30; battery 170 and circuit board 130 are already therein. Top and bottom covers 40, 50 are then attached 250 to each other and/or to main housing part 30, e.g., by a snap or friction fit, adhesive, heat welding, ultrasonic welding or any other suitable fastening.

At this point all of the mechanical and electrical elements of light 10 have been substantially assembled 225-250 and light 10 may be electrically tested 255 if desired.

Process 200 next proceeds to providing a conformal lens over LED circuit board 110 which is disposed in channel 33 of housing 20. To that end, a predetermined volume of clear conformal coating material is dispensed 260 onto LED circuit board 110 which is already disposed in channel 33 of housing 20 with spring clip 114 holding it in place.

Preferably, the conformal coating material dispensed 120 onto LED circuit board 110 is of a suitable viscosity such that the suitable predetermined quantity thereof dispensed 260 on top of circuit board 110 can be allowed to flow and level 265 under the influence of gravity and/or surface tension, thereby to cover circuit board 110 with a relatively thin layer of conformal coating material 120 that has flowed to a substantially uniform thickness. Thereafter, the layer of conformal coating material 120 is cured 270, e.g., by passage of time, by applying heat, by exposure to ultraviolet light or to other activating light, moving air, or other suitable curing.

Lighting device 10 is now complete and may be electrically tested 275 in its final configuration prior to being inspected, packaged and shipped 280, which ends process 200.

Figure 6:
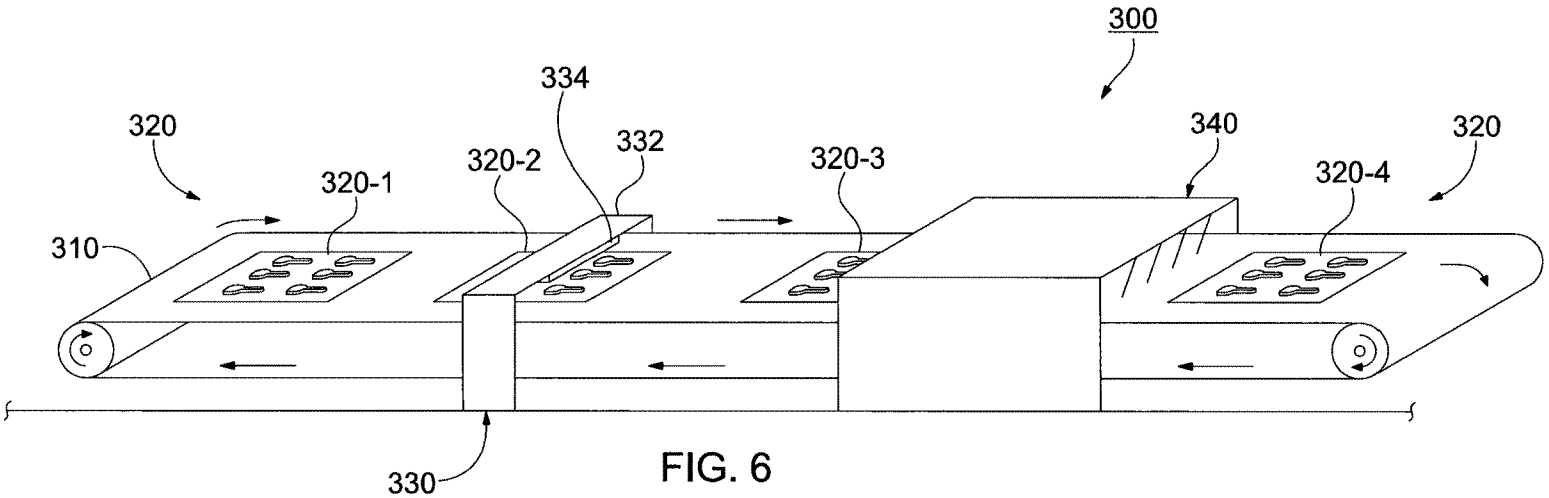
FIG. 6 is a schematic diagram of an example embodiment of a processing facility suitable for processing the example lighting device described herein in accordance with the method of FIG. 5.

FIG. 6 is a schematic diagram of an example embodiment of a processing facility 300 suitable for processing the example lighting device 10 described herein in accordance with the method 200 of FIG. 5. Processing facility 300 includes a conveyor 310, e.g., a belt conveyor 310, which moves in the direction indicated by the arrows in the FIG. 6. On conveyor 310 are shown a number of trays or fixtures or pallets 320 (e.g., 320-1-320-4) each of which carries a plurality of lights 10 that have been and are being processed in accordance with process 200 or other wise to be initially in the condition needed to begin step 260. The lights 10 on tray 320-1 are in the aforementioned state. While six lights 10 are illustrated, it is contemplated that a greater number of lights, e.g., 10 or 12 or 15 or 18, will be carried by each tray.

Trays or pallets 320-1 et seq move with conveyor 310 to pass through dispenser 330 which comprises a gantry-like support 332 that bridges transversely over conveyor 310 so that the trays 320 thereon pass through dispenser 330. Dispenser 330 also comprises one or more dispensing stations 334 from which a predetermined amount of clear conformal coating material 120 is dispensed onto the LED circuit boards 110 in the recesses or channels 33 of the lights 10 that are under dispensing station 334. Dispensing stations 334 may include, e.g., a plurality of dispensing nozzles, e.g., equal in number to the number of lights 10 that are disposed in a transverse line on trays 320-1 et seq, or may include a lesser number of dispensing nozzles that are translated across conveyor 310 and trays 320 thereon to dispense the predetermined amount of conformal coating material into each light 10 as the dispensing nozzle is over each particular light 10. Tray 320-2 carries lights 10 onto which the clear coating material has been dispensed.

Dispenser 330 may dispense the conformal coating material 120 in one place on LED circuit board 110, e.g., a central place or a preferred place closer to one end thereof, or where circuit board 110 is elongated as illustrated, then at more than one place along circuit board 110 or in a line along circuit board 110, as may be desired. In the arrangement of light 10 illustrated, the predetermined amount of conformal coating material 120 is preferably sufficient of cover circuit board 110 and to seal around spring clip 114 and into the opening between channel 33 in the blade of main housing part 30 and the cavity in the bow end thereof.

In the time it takes for conveyor 310 to move tray 320-2 from dispenser 330 to curing station 340, i.e. the position of tray 320-3, sufficient time has elapsed for the conformal coating material to spread and level over LED circuit board 110. Trays 320-3 passing through curing station 340 are exposed to the curing environment appropriate to the particular conformal coating material being employed, be that heat, light, ultraviolet light, moving air, or another curing environment. While curing time can depend upon the type of conformal coating material employed, curing times of about one minute are reasonable. Trays 320-4 exiting curing station 340 carry lights 10 in which conformal coating material 120 has been cured to form a thin clear (transparent or translucent) covering over LED circuit board 110 and spring clip 114, thereby completing the manufacture of lights 10, which are ready to be packaged and shipped.

Alternatively, any one or more of the foregoing can be performed manually and/or the processed lights being moved from station to station manually. Thus, a worker could dispense the predetermined amount of conformal coating material 120 into each light manually, could place the lights with leveled conformal coating material into the curing environment manually, and/or could move lights 10 individually or in groups from station to station, as may be convenient and desirable in any given situation. However, automated processing as described is thought to be preferred because it can result in a more uniform and consistent product.

Advantages of the foregoing method and of the light made thereby may include: a resistance to moisture provided by the sealing action of conformal coating 120, protection of the LEDs 118 by the conformal coating, resistance to breakage, simplified manufacturing and elimination of a separate lens and fastening to retain the lens in place, improved uniformity of product due to the automated processing, where employed. In addition, the part of light 10 that contains the recess for the LED circuit board may be made thinner with a conformal coating covering material for the LED circuit board than if a separate lens and lens retainer were to be utilized.

In a typical example embodiment, main housing part 30 may be die-cast or investment cast of a zinc alloy, a base metal, aluminum, brass, or other metal or may be molded of a suitable plastic, or may be machined or otherwise formed, and may be plated if desired. Covers 40 and 50 may be molded of a suitable plastic, and actuator button 60 and connector cover 70 may be molded of a suitable flexible and/or resilient plastic or rubber. Suitable plastics may include, e.g., a nylon, engineered nylon, polycarbonate, polyethylene, a PC/PET plastic blend, ABS plastic, PC/ABS plastic blend, glass-fiber filled plastic, with or without a reinforcing material such as glass fibers, carbon fibers or the like, or any other suitable plastic or other moldable or cast-able material. Suitable flexible and/or resilient plastics and rubbers may include, e.g., a resilient polymer, elastomer or other plastic material, a urethane, silicone, rubber, silicone rubber, neoprene, synthetic rubber, or the like. Conformal lens 120 may be any optically clear (transparent or translucent) material such as a silicone, silicone gel, urethane, parylene, resin, acrylate resin, epoxy, potting compound, adhesive, encapsulant, casting resin, conformal coating, or a suitable combination thereof, and may be curable by passage of time, heat, light, ultraviolet light or other suitable curing, as applicable.

In a preferred embodiment, battery 170 is a substantially rectangular (also referred to as prismatic) shaped rechargeable lithium polymer battery providing a voltage over a range of about 2.5-4.2 VDC while charging and discharging, with an example capacity of about 110 milliampere-hours. Because a lithium polymer battery has a long lifetime and may be discharged and recharged many times, e.g., typically in a range of about 300-500 times, there is no need for battery 170 to be replaced and so housing 20 may be permanently assembled. Thus, it is preferred that covers 40, 50 be permanently attached to each other and optionally to main housing 30, e.g., by an adhesive, ultrasonic weld, heat weld, or another permanent fastening.

A battery of a different voltage and/or chemistry may be employed and a DC converter may be provided, e.g., on control circuit board 130, for converting the nominal+5 VDC available from USB chargers to a voltage suitable for charging battery 170. A DC converter may also be provided for converting the voltage available from battery 170 to a voltage and current providing a desired operating condition for the LEDs of circuit board 110 (typically, it is the current flowing through the LEDs of circuit board 110 that is controlled). Covers 40, 50 and actuator 60 may be attached together and/or to main housing 30 by, e.g., an adhesive, heat welding, sonic welding, snap fastening, or other suitable fastener.

Therein, in a typical example of lighting device 10 that is in the example shape of a key, lighting device 10 is about 2.9 inches (about 7.4 cm) in length, blade 32 thereof is about 1.6 inches (about 4.2 cm) long, about 0.33 inch (about 8.5 mm) wide and about 0.16 inch (about 4 mm) thick, and the bow end thereof is about 1.1 inches (about 2.7 cm) across and about 0.5 inch (about 13 mm) thick.

A lighting device 10 may comprise: a housing 20 defining a recess configured to receive a light emitting circuit 100, 110 and defining a cavity configured to receive a battery 170; a circuit board 100, 110, 130 containing the light emitting circuit 100, 110 and disposed in the recess of the housing 20, wherein the light emitting circuit 100, 110 may include one or more light emitting diodes mounted to the circuit board 100, 110, 130 so as to be exposed when the circuit board 100, 110, 130 is disposed in the recess of the housing 20; a battery 170 disposed in the cavity of the housing 20; a translucent or transparent conformal lens 120 covering the circuit board 100, 110, 130 disposed in the recess of the housing 20 and the one or more light emitting diodes thereon, wherein the translucent or transparent conformal lens 120 is formed in the recess to cover the circuit board 100, 110, 130 and to secure the circuit board 100, 110, 130 in the recess of the housing 20; and an electrical switch 60, 150 for selectively energizing the light emitting circuit 100, 110 to cause the one or more light emitting diodes thereof to produce light. The battery 170 may be a rechargeable battery 170, the lighting device 10 may further comprise: a connector 170 supported by the housing 20 to receive charging current from a mating connector that is configured to mate with the connector 170, wherein the connector 170 is coupled to the rechargeable battery 170 for providing charging current received from the mating connector to the rechargeable battery 170. The housing 20 may include: a main housing part 30 defining the recess and at least a part of the cavity, and one or more covers 40, 50 attached to the main housing part 30; or a main housing part 30 in a shape resembling a key having a blade 32 and a bow 34, the main housing part 30 defining the recess in the blade thereof and at least a part of the cavity, and one or more covers 40, 50 attached to the bow of the main housing part 30. The lighting device 10 may further comprise a second circuit board 130, wherein the second circuit board 100, 110, 130 is disposed in the cavity of the housing 20 adjacent the battery 170, supports the electrical switch 150, and is coupled to the circuit board 100, 110, 130 containing the light emitting circuit 100, 110. The translucent or transparent conformal lens 120 may include a conformal coating cured in situ covering the circuit board 110 in the recess of the housing 20. The conformal coating: may be an optically transparent or translucent material selected from the group including silicone, silicone gel, urethane, parylene, resin, acrylate resin, epoxy, potting compound, adhesive, encapsulant, casting resin, conformal coating, and a combination thereof; and may be cured by passage of time, by heat, by light, by ultraviolet light, or by a combination thereof. The conformal coating may be a colorless casting resin curable by light. The connector 170 may include a standard USB connector 170, a mini-USB connector 170, a micro-USB connector 170, or a lightning connector 170. The lighting device 10 may further comprise: a connector cover 70 insertable in the housing 20 to cover the connector 170; or a connector cover 70 tethered to the housing 20 and insertable in the housing 20 to cover the connector 170. The connector cover 70 may include a cover part, a base part and a tether connecting the cover part and the base part, wherein the base part is disposed in a receptacle of the housing 20, 30. The housing 20 may define: a hanger loop 80 extending outwardly therefrom; or a hanger loop 80 extending outwardly therefrom having a gap therein, and a gate 90 for closing the gap in the hanger loop 80.

A lighting device 10 may comprise: a housing 20 defining a recess configured to receive a light emitting circuit 100, 110 and defining a cavity configured to receive a battery 170; the housing 20 including a main housing part 30 defining the recess and a periphery of the cavity, and first and second covers 40, 50 mountable to the periphery of the housing 20 to enclose the cavity; a circuit board 100, 110, 130 containing the light emitting circuit 100, 110 and disposed in the recess of the main housing part 30, wherein the light emitting circuit 100, 110 may include one or more light emitting diodes mounted to the circuit board 100, 110, 130 so as to be exposed when the circuit board 100, 110, 130 is disposed in the recess of the main housing part 30; a battery 170 disposed in the cavity between the first and second covers of the housing 20; a translucent or transparent conformal lens 120 covering the circuit board 100, 110, 130 disposed in the recess of the main housing part 30 and the one or more light emitting diodes 118 thereon, wherein the translucent or transparent conformal lens 120 covers and secures the circuit board 100, 110, 130 in the recess of the main housing part 30; and a switch 60, 150 for selectively energizing the light emitting circuit 100, 110 to cause the one or more light emitting diodes 118 thereof to produce light, the switch 60, 150 including an electrical switch 150 disposed in the cavity of the housing 20 and an actuator 60 of the electrical switch 60, 150 disposed in one of the first and second covers 40, 50. The battery 170 may be a rechargeable battery 170, and the lighting device 10 may further comprise: a connector 170 supported by the housing 20 to receive charging current from a mating connector that is configured to mate with the connector 170, wherein the connector 170 is accessible through an opening in the housing 20 and is coupled to the rechargeable battery 170 for providing charging current received from the mating connector to the rechargeable battery 170. The main housing part 30 may be in a shape resembling a key having a blade 32 and a bow 34, the main housing part 30 defining the recess in the blade 32 thereof and the bow 34 defining at least the periphery of the cavity, wherein the first and second covers 40, 50 are mounted to the bow 34 of the main housing part 30. The lighting device 10 may further comprise a second circuit board 130, wherein the second circuit board 130 is disposed in the cavity of the housing 20 adjacent the battery 170, supports the electrical switch 150, and is coupled to the circuit board 100, 110, containing the light emitting circuit 100, 110. The translucent or transparent conformal lens 120 may include a conformal coating cured in situ covering the circuit board 100, 110, 130 in the recess of the housing 20. The conformal coating: may be an optically transparent or translucent material selected from the group including silicone, silicone gel, urethane, parylene, resin, acrylate resin, epoxy, potting compound, adhesive, encapsulant, casting resin, conformal coating, and a combination thereof; and may be cured by passage of time, by heat, by light, by ultraviolet light, or by a combination thereof. The conformal coating may be a colorless casting resin curable by light. The connector 170 may include a standard USB connector 170, a mini-USB connector 170, a micro-USB connector 170, or a lightning connector 170. The lighting device 10 may further comprise: a connector cover 70 insertable in the housing 20 to cover the connector 170; or a connector cover 70 tethered to the housing 20 and insertable in the housing 20 to cover the connector 170. The connector cover 70 may include a cover part, a base part and a tether connecting the cover part and the base part, wherein the base part is disposed in a receptacle of the main housing part 30. The housing 20 may define: a hanger loop 80 extending outwardly from the housing 20; or a hanger loop 80 extending outwardly from the main housing part 30; or a hanger loop 80 extending outwardly from the housing 20 and having a gap therein, and a gate 90 for closing the gap in the hanger loop 80; or a hanger loop 80 extending outwardly from the main housing part 30 and having a gap therein, and a gate 90 for closing the gap in the hanger loop 80.

A lighting device 10 may comprise: a housing 20 configured in a shape resembling a key having a blade and a bow, the housing 20 defining a recess in the blade thereof configured to receive a light emitting circuit 100, 110 and defining a cavity in the bow thereof configured to receive a battery 170; a circuit board 100, 110, 130 containing the light emitting circuit 100, 110 and disposed in the recess of the blade of the main housing part 30, wherein the light emitting circuit 100, 110 may include one or more light emitting diodes mounted to the circuit board 100, 110, 130 so as to be exposed when the circuit board 100, 110, 130 is disposed in the recess of the blade of the main housing part 30; a battery 170 disposed in the cavity of the bow of the housing and coupled to the lighting circuit; a translucent or transparent conformal lens 120 covering the circuit board 100, 110, 130 disposed in the recess of the blade of the housing 20, 30 and covering the one or more light emitting diodes 118 thereon, wherein the translucent or transparent conformal lens 120 covers and secures the circuit board 100, 110, 130 in the recess of the blade of the housing 20, 30; and a switch 60, 150 for selectively energizing the light emitting circuit 100, 110 to cause the one or more light emitting diodes 118 thereof to produce light, the switch 60, 150 including an electrical switch 150 disposed in the cavity of the bow of the housing 20, 30. The one or more light emitting diodes 118 disposed in the recess in the bow 34 of the housing 20, 30 may direct light away therefrom in a first direction and wherein the switch 60, 150 may be disposed on a surface of the housing 20 facing in a direction opposite to the first direction. The housing 20 may include a main housing part 30 in the shape resembling a key having a blade 32 and a bow 34, the main housing part 30 defining the recess in the blade 32 thereof and defining at least the periphery of the cavity in the bow 34 thereof, the housing 20 further including at least one cover 40, 50 mounted to the bow of the main housing part 30 to enclose the cavity. The switch 60, 150 may include an actuator 60 disposed in the at least one cover 40, 50 for actuating the electrical switch 150. The battery 170 may be a rechargeable battery 170. The lighting device 10 may further comprise a connector 170 supported by the housing 20 to receive charging current from a mating connector that is configured to mate with the connector 170, wherein the connector 170 is accessible through an opening in the housing 20 and is coupled to the rechargeable battery 170 for providing charging current received from the mating connector to the rechargeable battery 170. The connector 170 may include a standard USB connector 170, a mini-USB connector 170, a micro-USB connector 170, or a lightning connector 170. The translucent or transparent conformal lens 120 may include a conformal coating cured in situ covering the circuit board 100, 110, 130 in the recess of the housing 20. The conformal coating: may be an optically transparent or translucent material selected from the group including silicone, silicone gel, urethane, parylene, resin, acrylate resin, epoxy, potting compound, adhesive, encapsulant, casting resin, conformal coating, and a combination thereof; and may be cured by passage of time, by heat, by light, by ultraviolet light, or by a combination thereof. The conformal coating may be a colorless casting resin curable by light.

A method 200 for making a lighting device 10 may comprise: obtaining 220 a circuit board 100, 110, 130 having one or more light emitting devices mounted on one surface thereof; obtaining 210 a housing 20 having a recess configured to receive the circuit board 100, 110, 130; placing 235 the circuit board 100, 110, 130 in the recess of the housing 20; then dispensing 260 a predetermined amount of a conformal coating material onto the circuit board 100, 110, 130 which is in the recess; allowing 265 the dispensed conformal coating material to spread and level on the circuit board 100, 110, 130 in the recess; and curing 270 the spread and leveled conformal coating material to form a cover on the circuit board 100, 110, 130 in the recess; whereby a cover 120 is formed in place on the circuit board 100, 110, 130 in the recess. The method 200 may further comprise: placing 235 a battery 170 and a switch 150 into a cavity of the housing 20; and placing 245 one or more covers on the housing 20 to enclose the cavity of the housing 20 with the battery 170 and switch 150 therein. The one of the one or more covers 40, 50 may include a flexible actuator 60 configured to actuate the electrical switch 150 in the cavity of the housing 20. The conformal coating may be an optically transparent or translucent material selected from the group including: silicone, silicone gel, urethane, parylene, resin, acrylate resin, epoxy, potting compound, adhesive, encapsulant, casting resin, conformal coating, and a combination thereof. The method 200 may further comprise curing the conformal coating by passage of time, by heat, by light, or by ultraviolet light. The conformal coating may be transparent, translucent, or clear, and is colorless or tinted. The method 200 may further comprise: placing 240 a spring clip into the recess to retain the circuit board 100, 110, 130 therein prior to dispensing 260 a predetermined amount of a conformal coating material onto the circuit board 100, 110, 130 which is in the recess. The light emitting devices 118 may be: light emitting diodes 118; or surface mounted on the circuit board 100, 110, 130; or light emitting diodes 118 that are surface mounted on the circuit board 100, 110, 130. The obtaining 220 a circuit board 100, 110, 130 may include obtaining 220, 225 an assembly 100 of one or more circuit boards 110, 130 having one or more light emitting devices 118 thereon and having an electrical switch 150 mounted thereon.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "rearward," "under" and/or "over," "vertical," "horizontal," and the like, may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B." In addition, the term "at least one of" one or more elements is intended to include one of any one of the elements, more than one of any of the elements, and two or more of the elements up to and including all of the elements, and so, e.g., the phrase in the form "at least one of A, B and C" includes "A," "B," "C," "A and B," "A and C," "B and C," and "A and B and C."

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both.

Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH), lithium-polymer, or lithium-ion (Li-Ion) battery type, of a suitable number of cells and cell capacity for providing a desired operating time and/or lifetime for a particular device, and may be intended for a single use or for being rechargeable or for both.

The term DC converter is used herein to refer to any electronic circuit that receives at an input electrical power at one voltage and current level and provides at an output DC electrical power at a different voltage and/or current level. Examples may include a DC-DC converter, an AC-DC converter, a boost converter, a buck converter, a buck-boost converter, a single-ended primary-inductor converter (SEPIC), a series regulating element, a current level regulator, and the like. The input and output thereof may be DC coupled and/or AC coupled, e.g., as by a transformer and/or capacitor. A DC converter may or may not include circuitry for regulating a voltage and/or a current level, e.g., at an output thereof, and may have one or more outputs providing electrical power at different voltage and/or current levels and/or in different forms, e.g., AC or DC.

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, an adhesive, and the like.

While various operations, steps and/or elements of a process or method or operation may be described in an order or sequence, the operations, steps and/or elements do not need to be performed in that order or sequence, or in any particular order or sequence, unless expressly stated to require a particular order or sequence.

As used herein, the terms "connected" and "coupled" as well as variations thereof are not intended to be exact synonyms, but to encompass some similar things and some different things. The term "connected" may be used generally to refer to elements that have a direct electrical and/or physical contact to each other, whereas the term "coupled" may be used generally to refer to elements that have an indirect electrical and/or physical contact with each other, e.g., via one or more intermediate elements, so as to cooperate and/or interact with each other, and may include elements in direct contact as well.

While the present invention has been described in terms of the foregoing example embodiments, variations within the scope and spirit of the present invention as defined by the claims following will be apparent to those skilled in the art. For example, while the example lighting device 10 is illustrated as being in the shape of a key, and may be of a size suitable for being carried on a key ring or key case, light 10 may be of any desired size and shape, including a size that could be considered small or a size that could be considered large.

For example, lighting device 10 may be in the shape of a triangle, square, a star or a pentagon with the top and bottom covers centrally located to contain the control circuit board, rechargeable battery and connector, and, e.g., with the corners or points thereof containing LEDs in recesses therein covered by a conformal lens.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made.

Each of the U.S. Provisional applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A lighting device comprising:

a housing defining a recess configured to receive a light emitting circuit and defining a cavity configured to receive a battery;

a circuit board containing the light emitting circuit and disposed in the recess of said housing, wherein the light emitting circuit includes one or more light emitting diodes mounted to said circuit board so as to be exposed when said circuit board is disposed in the recess of said housing;

a battery disposed in the cavity of said housing;

a translucent or transparent conformal lens covering said circuit board disposed in the recess of said housing and the one or more light emitting diodes thereon, wherein said translucent or transparent conformal lens is formed in the recess to cover said circuit board and to secure said circuit board in the recess of said housing; and an electrical switch for selectively energizing said light emitting circuit to cause said one or more light emitting diodes thereof to produce light.

2. The lighting device of claim 1 wherein said battery is a rechargeable battery, said lighting device further comprising: a connector supported by said housing to receive charging current from a mating connector that is configured to mate with said connector, wherein said connector is coupled to said rechargeable battery for providing charging current received from the mating connector to said rechargeable battery.

3. The lighting device of claim 2 wherein said connector includes a standard USB connector, a mini-USB connector, a micro-USB connector, or a lightning connector.

4. The lighting device of claim 2 further comprising:

a connector cover insertable in said housing to cover said connector; or a connector cover tethered to said housing and insertable in said housing to cover said connector.

5. The lighting device of claim 4 wherein said connector cover includes a cover part, a base part and a tether connecting the cover part and the base part, wherein said base part is disposed in a receptacle of said housing.

6. The lighting device of claim 1 wherein said housing includes:

a main housing part defining the recess and at least a part of the cavity, and one or more covers attached to said main housing part; or a main housing part in a shape resembling a key having a blade and a bow, the main housing part defining the recess in the blade thereof and at least a part of the cavity, and one or more covers attached to the bow of said main housing part.

7. The lighting device of claim 1 further comprising a second circuit board, wherein said second circuit board is disposed in the cavity of said housing adjacent said battery, supports said electrical switch, and is coupled to said circuit board containing the light emitting circuit.

8. The lighting device of claim 1 wherein said translucent or transparent conformal lens includes a conformal coating cured in situ covering said circuit board in the recess of said housing.

9. The lighting device of claim 8 wherein the conformal coating:

is an optically transparent or translucent material selected from the group including silicone, silicone gel, urethane, parylene, resin, acrylate resin, epoxy, potting compound, adhesive, encapsulant, casting resin, conformal coating, and a combination thereof; and is cured by passage of time, by heat, by light, by ultraviolet light, or by a combination thereof.

10. The lighting device of claim 8 wherein the conformal coating is a colorless casting resin curable by light.

11. The lighting device of claim 1 wherein said housing defines:

a hanger loop extending outwardly therefrom; or a hanger loop extending outwardly therefrom having a gap therein, and a gate for closing the gap in said hanger loop.

12. A lighting device comprising:

a housing defining a recess configured to receive a light emitting circuit and defining a cavity configured to receive a battery;

said housing including a main housing part defining the recess and a periphery of the cavity, and first and second covers mountable to the periphery of said housing to enclose the cavity;

a circuit board containing the light emitting circuit and disposed in the recess of said main housing part, wherein the light emitting circuit includes one or more light emitting diodes mounted to said circuit board so as to be exposed when said circuit board is disposed in the recess of said main housing part;

a battery disposed in the cavity between the first and second covers of said housing;

a translucent or transparent conformal lens covering said circuit board disposed in the recess of said main housing part and the one or more light emitting diodes thereon, wherein said translucent or transparent conformal lens covers and secures said circuit board in the recess of said main housing part; and a switch for selectively energizing said light emitting circuit to cause said one or more light emitting diodes thereof to produce light, said switch including an electrical switch disposed in the cavity of said housing and an actuator of the electrical switch disposed in one of said first and second covers.

13. The lighting device of claim 12 wherein said battery is a rechargeable battery, said lighting device further comprising: a connector supported by said housing to receive charging current from a mating connector that is configured to mate with said connector, wherein said connector is accessible through an opening in said housing and is coupled to said rechargeable battery for providing charging current received from the mating connector to said rechargeable battery.

14. The lighting device of claim 13 wherein said connector includes a standard USB connector, a mini-USB connector, a micro-USB connector, or a lightning connector.

15. The lighting device of claim 13 further comprising:

a connector cover insertable in said housing to cover said connector; or a connector cover tethered to said housing and insertable in said housing to cover said connector.

16. The lighting device of claim 15 wherein said connector cover includes a cover part, a base part and a tether connecting the cover part and the base part, wherein said base part is disposed in a receptacle of said main housing part.

17. The lighting device of claim 12 wherein said main housing part is in a shape resembling a key having a blade and a bow, the main housing part defining the recess in the blade thereof and the bow defining at least the periphery of the cavity, wherein said first and second covers are mounted to the bow of said main housing part.

18. The lighting device of claim 12 further comprising a second circuit board, wherein said second circuit board is disposed in the cavity of said housing adjacent said battery, supports said electrical switch, and is coupled to said circuit board containing the light emitting circuit.

19. The lighting device of claim 12 wherein said translucent or transparent conformal lens includes a conformal coating cured in situ covering said circuit board in the recess of said housing.

20. The lighting device of claim 19 wherein the conformal coating:

is an optically transparent or translucent material selected from the group including silicone, silicone gel, urethane, parylene, resin, acrylate resin, epoxy, potting compound, adhesive, encapsulant, casting resin, conformal coating, and a combination thereof; and is cured by passage of time, by heat, by light, by ultraviolet light, or by a combination thereof.

21. The lighting device of claim 19 wherein the conformal coating is a colorless casting resin curable by light.

22. The lighting device of claim 12 wherein said housing defines:

a hanger loop extending outwardly from said housing; or a hanger loop extending outwardly from said main housing part; or a hanger loop extending outwardly from said housing and having a gap therein, and a gate for closing the gap in said hanger loop;

a hanger loop extending outwardly from said main housing part and having a gap therein, and a gate for closing the gap in said hanger loop.

23. A lighting device comprising:

a housing configured in a shape resembling a key having a blade and a bow, said housing defining a recess in the blade thereof configured to receive a light emitting circuit and defining a cavity in the bow thereof configured to receive a battery;

a circuit board containing the light emitting circuit and disposed in the recess of the blade of said housing, wherein the light emitting circuit includes one or more light emitting diodes mounted to said circuit board so as to be exposed when said circuit board is disposed in the recess of the blade of said main housing part;

a battery disposed in the cavity of the bow of said housing and coupled to said lighting circuit;

a translucent or transparent conformal lens covering said circuit board disposed in the recess of the blade of said housing and covering the one or more light emitting diodes thereon, wherein said translucent or transparent conformal lens covers and secures said circuit board in the recess of the blade of said housing; and a switch for selectively energizing said light emitting circuit to cause said one or more light emitting diodes thereof to produce light, said switch including an electrical switch disposed in the cavity of the bow of said housing.

24. The lighting device of claim 23 wherein the one or more light emitting diodes disposed in the recess in the bow of said housing direct light away therefrom in a first direction and wherein said switch is disposed on a surface of said housing facing in a direction opposite to the first direction.

25. The lighting device of claim 23 wherein said housing includes a main housing part in the shape resembling a key having a blade and a bow, said main housing part defining the recess in the blade thereof and defining at least the periphery of the cavity in the bow thereof, said housing further including at least one cover mounted to the bow of said main housing part to enclose the cavity.

26. The lighting device of claim 25 wherein said switch includes an actuator disposed in said at least one cover for actuating said electrical switch.

27. The lighting device of claim 23 wherein said battery is a rechargeable battery.

28. The lighting device of claim 27 further comprising a connector supported by said housing to receive charging current from a mating connector that is configured to mate with said connector, wherein said connector is accessible through an opening in said housing and is coupled to said rechargeable battery for providing charging current received from the mating connector to said rechargeable battery.

29. The lighting device of claim 28 wherein said connector includes a standard USB connector, a mini-USB connector, a micro-USB connector, or a lightning connector.

30. The lighting device of claim 23 wherein said translucent or transparent conformal lens includes a conformal coating cured in situ covering said circuit board in the recess of said housing.

31. The lighting device of claim 30 wherein the conformal coating:

is an optically transparent or translucent material selected from the group including silicone, silicone gel, urethane, parylene, resin, acrylate resin, epoxy, potting compound, adhesive, encapsulant, casting resin, conformal coating, and a combination thereof; and is cured by passage of time, by heat, by light, by ultraviolet light, or by a combination thereof.

32. The lighting device of claim 30 wherein the conformal coating is a colorless casting resin curable by light.

33. A method for making a lighting device according to claim 1 comprising:

obtaining a circuit board having one or more light emitting devices mounted on one surface thereof;

obtaining a housing having a recess configured to receive the circuit board;

placing the circuit board in the recess of the housing;

then dispensing a predetermined amount of a conformal coating material onto the circuit board which is in the recess;

allowing the dispensed conformal coating material to spread and level on the circuit board in the recess; and curing the spread and leveled conformal coating material to form the translucent or transparent conformal lens on the circuit board in the recess;

whereby the translucent or transparent conformal lens is formed in place on the circuit board in the recess.

34. The method of claim 33 further comprising:

placing the battery and the electrical switch into the cavity of the housing; and placing one or more covers on the housing to enclose the cavity of the housing with the battery and switch therein.

35. The method of claim 34 wherein one of the one or more covers includes a flexible actuator configured to actuate the electrical switch in the cavity of the housing.

36. The method of claim 33 wherein the conformal coating is an optically transparent or translucent material selected from the group including: silicone, silicone gel, urethane, parylene, resin, acrylate resin, epoxy, potting compound, adhesive, encapsulant, casting resin, conformal coating, and a combination thereof.

37. The method of claim 33 further comprising curing the conformal coating by passage of time, by heat, by light, or by ultraviolet light.

38. The method of claim 33 wherein the conformal coating is transparent, translucent, or clear, and is colorless or tinted.

39. The method of claim 33 further comprising:

placing a spring clip into the recess to retain the circuit board therein prior to dispensing a predetermined amount of a conformal coating material onto the circuit board which is in the recess.

40. The method of claim 33 wherein the light emitting devices are:

light emitting diodes; or surface mounted on the circuit board; or light emitting diodes that are surface mounted on the circuit board.

41. The method of claim 33 wherein the obtaining the circuit board includes obtaining an assembly of one or more circuit boards having one or more light emitting devices thereon and having the electrical switch mounted thereon.

42. The method of claim 33 wherein the dispensing a predetermined amount of a conformal coating material onto the circuit board includes dispensing the conformal coating material in a predetermined amount that is sufficient to form a seal between the circuit board and the housing in the recess thereof.

43. The lighting device of claim 1 wherein the translucent or transparent conformal lens forms a seal between the circuit board and said housing in the recess thereof.

44. The lighting device of claim 12 wherein the translucent or transparent conformal lens forms a seal between the circuit board and said housing in the recess of said main housing part.

45. The lighting device of claim 23 wherein the translucent or transparent conformal lens forms a seal between the circuit board and said housing in the recess of the blade thereof.

* * * * *